United States Patent [19]

Goto

[11] 4,094,050

[45] June 13, 1978

[54] BACKUP ROLL OF THE BUILT-UP TYPE

[75] Inventor: Hiroshi Goto, Muroran, Japan

[73] Assignee: The Japan Steel Works, Ltd., Tokyo, Japan

[21] Appl. No.: 768,616

[22] Filed: Feb. 14, 1977

[51] Int. Cl.[2] ..... B21B 31/08

[52] U.S. Cl. ..... 29/129.5

[58] Field of Search ..... 29/129.5, 110, 132

[56] References Cited

U.S. PATENT DOCUMENTS

| | | | |
|---|---|---|---|
| 2,018,247 | 10/1935 | Biggert et al. | 29/129.5 |
| 2,215,424 | 9/1940 | Klein | 29/129.5 |

*Primary Examiner*—Alfred R. Guest

*Attorney, Agent, or Firm*—Wenderoth, Lind & Ponack

[57] ABSTRACT

A backup roll of the built-up type has its shrinkage-fitting surface formed between an arbor and a sleeve divided into two portions, i.e. one an inward stepped shrinkage-fitting portion and the other an outward shrinkage-fitting portions, the former being formed on said shrinkage-fitting surface at substantially its mid portion in an axial direction for a limited length by an annular protrusion of said arbor and a corresponding annular dent of said sleeve and the latter being formed on said shrinkage-fitting surface at both sides of said inward stepped shrinkage-fitting portion, whereby the shrinkage ratio of said inward stepped shrinkage-fitting portion is selected to be as small as possible in so far as it can prevent the relative rotation between said arbor and said sleeve, whereas that of said outward shrinkage-fitting portions is selected to be far less than that of said outward stepped shrinkage-fitting portion, and is an extreme case even to zero.

6 Claims, 11 Drawing Figures

BACKUP ROLL OF THE BUILT-UP TYPE

BACKGROUND OF THE INVENTION

The present invention relates to rolls for use in rolling-mills and more particularly to backup rolls of the built-up type comprising an arbour and a sleeve which is shrinkage-fitted onto the arbour.

In the field of the backup rolls of this type heretofore many inventions have been developed with regard to shrinkage-fitting of a sleeve and an arbour, but most of them have had to solve a residual deformation of the roll which occurs during the actual rolling operation; however, the solutions already proposed require a very implicated constitution which results in making the actual application difficult. Accordingly, if the inventions already proposed in the past were actually useful so as to be practiced easily industrially, all questions relating at present in the art to the rolling operation would have been completely solved. But since almost all of the solutions put forward were those which had not fully considered the actual circumstances as abovementioned, questions inherent to built-up type backup rolls still exist.

SUMMARY OF THE INVENTION

An object of the present invention is to provide a backup roll of the built-up type which maybe industrially practiced easily and without all of the defects inherent to conventional rolls as abovementioned.

A further object of the present invention is to provide a backup roll of the built-up type which is resistant to either cracking or breaking in the sleeve.

In accordance with the present invention a backup roll of the built-up type comprising an arbour and a sleeve shrinkage-fitted onto the arbour is provided wherein the shrinkage-fitting surface formed between the outer surface of the arbour and the inner surface of the sleeve are provided with an inward stepped shrinkage-fitting portion and outward shrinkage-fitting portions. The inward stepped shrinkage-fitting portion is formed on substantially a mid portion of the shrinkage-fitting surface in the direction of the axis by shaping an annular protrusion around the arbour which has a limited length and shaping an annular dent around the sleeve which corresponds substantially to the protrusion shaped around the arbour. The outward shrinkage-fitting portions are formed on the shrinkage-fitting surface at both sides of the inward stepped shrinkage-fitting portion so as to extend to the outer ends of the shrinkage-fitting surface. Thus the shrinkage ratio of the inward stepped shrinkage-fitting portion is selected to be as small as possible in so far as it can prevent relative rotation between the arbour and the sleeve, whereas the shrinkage ratio of the outward shrinkage-fitting portions is selected to be far less than that of the inward stepped shrinkage-fitting portion. In a preferred embodiment of the present invention the length of the inward stepped shrinkage-fitting portion is selected to be one tenth to one fourth of the length of the shrinkage-fitting surface, and the shrinkage ratio is selected to be 0.1/1000 to 0.3/1000, the shrinkage ratio of the outward shrinkage-fitting portions being selected to be equal to or less than 0.1/1000, or even zero.

In another embodiment of the present invention it is also contemplated that an appropriate rounding is provided at the root corners of the annular protrusion of the arbour.

BRIEF DESCRIPTION OF THE DRAWINGS

These and other objects of the present invention will become more readily apparent upon reading of the following specification and upon referring to the accompanying drawings, in which.

DESCRIPTION OF THE PREFERRED EMBODIMENT

Figure 1:
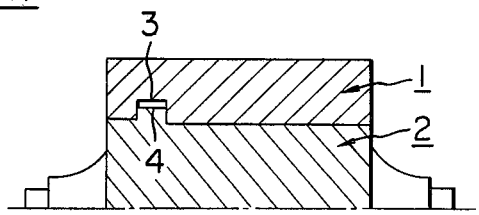
PRIOR ART FIG. 1
FIG. 1 is a diagrammatical view of a backup roll of the built-up type according to the teaching of a conventional overhang type.
Figure 2A:
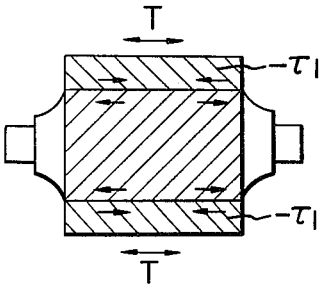
FIG. 2A to 2D are diagrammatical views showing the relation of an axial residual stress and a residual deflection in a backup roll of the built-up type.
Figure 2B:
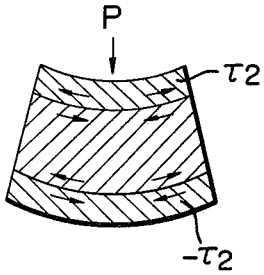
Figure 2C:
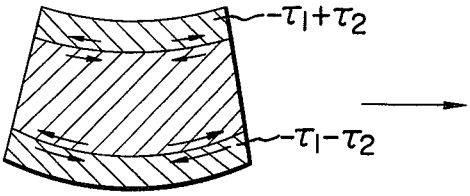
Figure 2D:
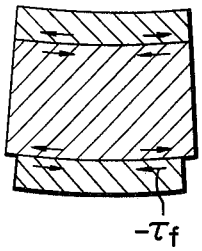

The crack occurring in a sleeve of a backup roll of the built-up type is caused by a sudden development of cracks which can occur by an end spalling, heat shock, etc. due to circumferential residual stress which is inevitably caused at the time of shrinkage-fitting the sleeve and the arbour. Accordingly, as a countermeasure therefor, it is desirable in order to reduce a shrinkage-fitting hoop stress as far as possible that a minimum shrinkage ratio be to be adopted, and in the extreme case even a zero shrinkage ratio is theoretically desirable. However, in reality, since the temperature of the backup rolls rises during their rolling operation, the sleeve expands to finally cause a relative axial shift between it and the arbour, thus the rolling operation becomes inpossible. As a countermeasure therefor, as shown in FIG. 1 of the attached drawings, a constitution hitherto referred to as an overhang type has been adopted in which a sleeve 1 and an arbour 2 are provided with an annular detent 3 and an annular protrusion 4 near one of their ends respectively. This way they can engage one another so as to confine the relative shift between them. In this case, it is unavoidable, however, that an axial tensile residual stress will occur due to inequality in the cooling velocity of the sleeve 1 at portions other than the engaging portions 3, 4. Consequently, as shown in FIGS. 2A to 2D a deformation due to the residual stress can easily appear because of the load caused by the rolling operation. FIG. 2A shows shearing stress $\tau_1$ caused at a shrinkage-fitting operation of the roll together with an axial tensile stress T; FIG. 2B shows shearing stress $\tau_2$ occuring when it is subjected to a compressive load P; FIG. 2C shows the combined shearing stress of the shearing stress $\tau_1$ due to the shrinkage-fitting and shearing stress $\tau_2$ due to bending upon application of the compressive load; and FIG. 2D shows a condition occurring due to a residual deformation. As to the detailed study, reference should be made to a publication entitled "Desertations" published by the Japan Learned Society of Mechanical Engineer, Vol. 32, No. 233, January 1966, pp 6 and the following.

Figure 3:
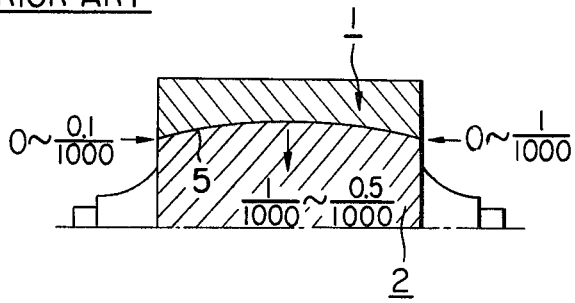
PRIOR ART FIG. 3
FIG. 3 is a diagrammatical view of a backup roll of the built-up type which has a barrel-like shrinkage-fitting surface according to the teaching of one of the conventional constructions.

As another solution that has is also known from Japanese Patent Publication No. 2247/1967 is that shown in FIG. 3. The shrinkage-fitting surfaces of a sleeve 1 and an arbour 2 of a backup roll of the built-up type are machined so as to have a smooth barrel configuration with the shrinkage ratio being gradually decreased from the mid portion of the sleeve 1 towards both ends in such a manner that the shrinkage ratio is 1 to 0.5/1000 at the mid portion and 0 to 0.1/1000 or 0 to 1/1000 at both ends, respectively. Although this solution may serve to remarkably decrease axial tensile stress it serves only to solve residual bending, because it necessiates a high shrinkage ratio at the mid-portion so that circumferential tensile stress cannot be relieved.

Figure 4:
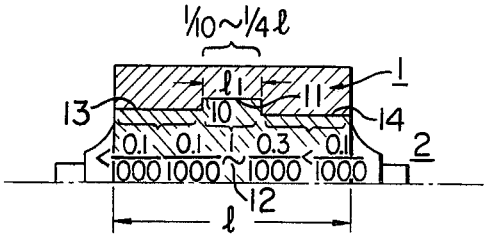
FIG. 4 is a diagrammatical view of one of the embodiments of a backup roll of the back-up type according to the present invention.

The present invention was achieved as a result of precise research for the object of the actualizing a theoretical fact that it is desirable for a shrinkage ratio in a back-up roll of the built-up type to be zero over the axial length of the roll as wide as possible. In reality the present invention can actualize a back-up roll of this type without easily compromising this fact. That is, in the present invention, without being adhered to the conventional overhang type roll as previously explained, as shown in FIG. 4, a back-up roll of the built-up type comprising an arbour 2 and a sleeve 1 is provided with an inward stepped shrinkage-fitting portion 10 on a shrinkage-fitting surface formed between the outer surface of the arbour 2 and the inner surface of the sleeve 1 at their mid portions in the axial direction, and the portion 10 is an annular protrusion 11 having a limited length shaped around the arbour 2 with a corresponding annular dent 12 shaped around the sleeve 1. Further, the back-up roll according to the present invention is provided with outward shrinkage-fitting portions 13, 14 on the shrinkage-fitting surface at both sides of the inward stepped shrinkage-fitting portion 10. In this case, the shrinkage ratio of the inward stepped shrinkage-fitting portion 10 is selected to an estimate so small that it can scarcely prevent the relative rotation between the sleeve 1 and the arbour 2 which may occur during the rolling operation. In other words, it is estimated to a minimum in so far as it is possible to transmit a torque between both, and the shrinkgate ratio of the outward shrinkage-fitting portions 13, 14 is selected to less than that of the inward stepped shrinkage-fitting portion 10. In the extreme case, it may be selected to be even zero.

The discussion of the inward stepped shrinkage-fitting portion 10 measured in the axial direction can be obtained from a formula of the transmission of torque between a sleeve and an arbour as described e.g. in a publication by "Kawasaki Steel Manufacturing Technical Reports" April 1975, page 102 and the following. However, in a practical application, it has been found to be out of the question that as shown in FIG. 4, the width $l_1$ of the inward stepped shrinkage-fitting portion 10 formed at the middle of the sleeve 1 and the arbour 2 is selected to be one tenth to one fourth of their length $l$ and the shrinkage ratio 0.1/1000 to 0.3/1000. Further, as to the height of the annular protrusion 11 of the arbour 2 or the depth of the annular dent 12 of the sleeve 1 it should be selected so as not to disturb the shrinkage-fitting operation of the arbour 2 onto the sleeve 1 at the time of their built-up operation which is to be explained more fully afterwards.

Figure 5A:
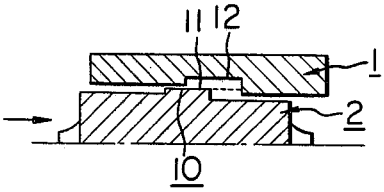
FIG. 5A to 5C are diagrammatical representations showing the process of the assembly of the roll shown in FIG. 4.
Figures 5B, 5C:
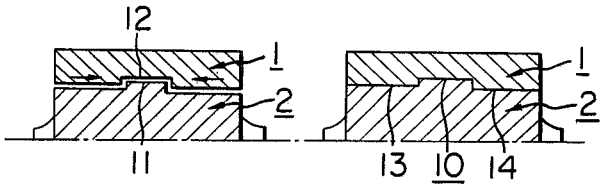

As to the details of the shape of the inward stepped shrinkage-fitting portion 10, as exaggerated in FIGS. 5A to 5C, the outer diameters of the shrinkage-fitting surfaces 13, 14 of the arbour 2 or the inner diameters of that of the sleeve 1 are made so as to be different between both sides of the inward stopped shrinkage-fitting portion 10, thus an annular protrusion 11 having different heights at both its ends is formed on the arbour 2 or an annular dent 12 having different depths at both its ends is formed. Thus, on assembly the arbour 2 is introduced into the heated sleeve 1 from the side having a smaller outer diameter on its shrinkage-fitting surface as shown in FIG. 5A until the annular end surface of the annular protrusion 11 having a larger height abuts against the annular end surface of the annular dent 12 of the sleeve 1 having a larger depth. This prevents the protrusion 11 of the arbour 2 from going past the dent 12 of the sleeve 1, and in this state the sleeve 1 and the arbour 2 come into contact firstly at the inward stepped shrinkage-fitting portion 10 having a larger shrinkage ratio as shown in FIG. 5B. After the sleeve 1 has completely cooled to be fully contracted, as shown in FIG. 5C, it comes into contact with the arbour 2 on their entire surfaces of the outward shrinkage-fitting portions 13, 14. Thus it will be appreciated that the back-up roll according to the present invention can also exhibit a similar effect as that shown in FIG. 3, that is, it can effectively reduce axial residual stress so that a residual deformation can be effectively eliminated.

Figure 6:
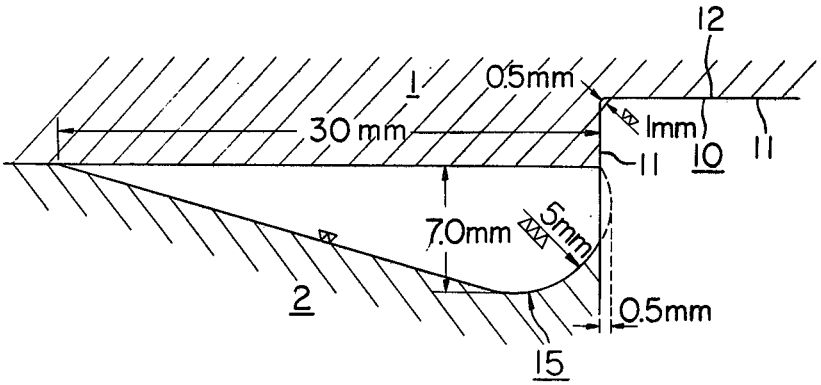
FIG. 6 is a partial longitudinal sectional view of the roll shown in FIG. 4 in an enlarged scale to show the detail of the stepped part of the arbour.

Further, in practicing the present invention explained so far, care should be taken that in order to avoid a stress concentration occurring at the corner ends of the annular protrusion 11 of the arbour 2, an appropriate rounding 15 having a definite radius of curvature is to be shaped so as to relieve the stress concentration at those portions as shown in FIG. 6. This procedure makes it possible to effectively avoid the breaking of the arbour due to the stress concentration. In this case the radius of the curvature of 5 mm may be applied to almost all of the backup rolls according to the present invention. Further it is also preferable for the corner ends of the annular dent 12 of the sleeve 1 to be rounded as shown in FIG. 6. In this case the radius of curvature of this rounding may be 0.5 mm.

What is claimed is:

1. In a backup roll of the built-up type comprising an arbour and a sleeve which is shrinkage-fitted on said arbour, the combination of an inward stepped shrinkage-fitting portion and outward shrinkage-fitting portions provided on the shrinkage-fitting surface formed between the outer surface of said arbour and the inner surface of said sleeve, said inward stepped shrinkage-fitting portion being formed on substantially a mid portion of said shrinkage-fitting surface by an annular protrusion around said arbour having a limited length of substantially one tenth to one fourth of the axial length of said shrinkage-fitting surface and an annular dent around said sleeve of a size corresponding to said protrusion, said outward shrinkage-fitting portions being formed on said shrinkage-fitting surface at both sides of said inward stepped shrinkage-fitting portion so as to extend to the outer ends of said shrinkage-fitting surface, the shrinkage ratio of said inward stepped shrinkage-fitting portion being a value which can afford a torque transmission between said arbour and said sleeve and the shrinkage ratio of said outward shrinkage-fitting portions being less than that of said inward shrinkage-fitting portion.

2. A backup roll of the built-up type as claimed in claim 1, wherein said inward stepped shrinkage-fitting portion has a shrinkage ratio of 0.1/1000 to 0.3/1000.

3. A backup roll of the built-up type as claimed in claim 1 wherein said shrinkage ratio of said outward shrinkage-fitting portions is selected to be equal to or less than 0.1/1000.

4. A back-up roll of the built-up type as claimed in claim 1 wherein said outward shrinkage-fitting portions have different sets of diameters of said arbour and said sleeve at both sides of said inward stepped shrinkage-fitting portions.

5. A back-up roll of the built-up type as claimed in claim 1 wherein said arbour is provided with a rounding at the respective root corners of said annular protrusion and said sleeve is also provided with a rounding at the respective inner corners of said annular dent.

6. A back-up roll of the built-up type as claimed in claim 5 wherein said roundings are selected to substantially 5 mm and 0.5 mm for said annular protrusion and said annular dent, respectively.

* * * * *